US006386851B1

(12) United States Patent
Gustafsson

(10) Patent No.: US 6,386,851 B1
(45) Date of Patent: May 14, 2002

(54) MULTI-STAGE UNIT FOR PROCESSING A WEB PACKAGING MATERIAL IN A FOOD PRODUCT PACKAGING MACHINE

(75) Inventor: Per Gustafsson, Bjärred (SE)

(73) Assignee: Tetra Laval Holdings & Finance S.A., Pully (SE)

( * ) Notice: Subject to any disclaimer, the term of this patent is extended or adjusted under 35 U.S.C. 154(b) by 63 days.

(21) Appl. No.: 09/702,898

(22) Filed: Nov. 1, 2000

(30) Foreign Application Priority Data

Dec. 22, 1999 (SE) ..... 9904728

(51) Int. Cl.[7] ..... B65H 23/18; B29C 70/74

(52) U.S. Cl. ..... 425/122; 226/2; 226/32; 425/126.1; 425/145

(58) Field of Search ..... 226/2, 32; 53/51; 425/145, 122, 126.1

(56) References Cited

U.S. PATENT DOCUMENTS

| | | | | |
|---|---|---|---|---|
| 3,126,431 A | * | 3/1964 | Harder et al. | 425/145 |
| 3,806,012 A | * | 4/1974 | Roch | 226/2 |
| 4,650,533 A | * | 3/1987 | Parker et al. | 156/219 |
| 4,782,987 A | * | 11/1988 | Giacomelli et al. | 226/2 |
| 5,022,950 A | * | 6/1991 | Ingalls et al. | 425/145 |
| 5,067,307 A | | 11/1991 | Francioni et al. | 53/450 |
| 5,297,712 A | * | 3/1994 | Kobayashi et al. | 226/27 |
| RE35,067 E | * | 10/1995 | Bauknecht | 226/32 |
| 6,136,261 A | * | 10/2000 | Wakabayashi et al. | 264/153 |

FOREIGN PATENT DOCUMENTS

| | | | |
|---|---|---|---|
| EP | 0043723 A2 | | 1/1982 |
| GB | 490395 | | 8/1938 |
| WO | WO98/18608 | * | 5/1998 |
| WO | WO98/18609 | * | 5/1998 |

OTHER PUBLICATIONS

International Search Report dated Sep. 6, 2000.

* cited by examiner

*Primary Examiner*—Robert Davis
(74) *Attorney, Agent, or Firm*—Burns, Doane, Swecker & Mathis, L.L.P.

(57) ABSTRACT

A multi-stage unit for processing a web packaging material in a machine for packaging food products, including a first processing station, a second processing station and a system for indexing the web packaging material comprising a first feeding device for step-feeding the web packaging material through the first processing station, a second feeding device for step-feeding the web packaging material through the second processing station, and a control unit controlling the first feeding device in response to a sensor detecting a first index code preprinted on the web packaging material, and the second feeding device in response to a second sensor detecting a second index code made on the web packaging material at said first processing station.

8 Claims, 1 Drawing Sheet

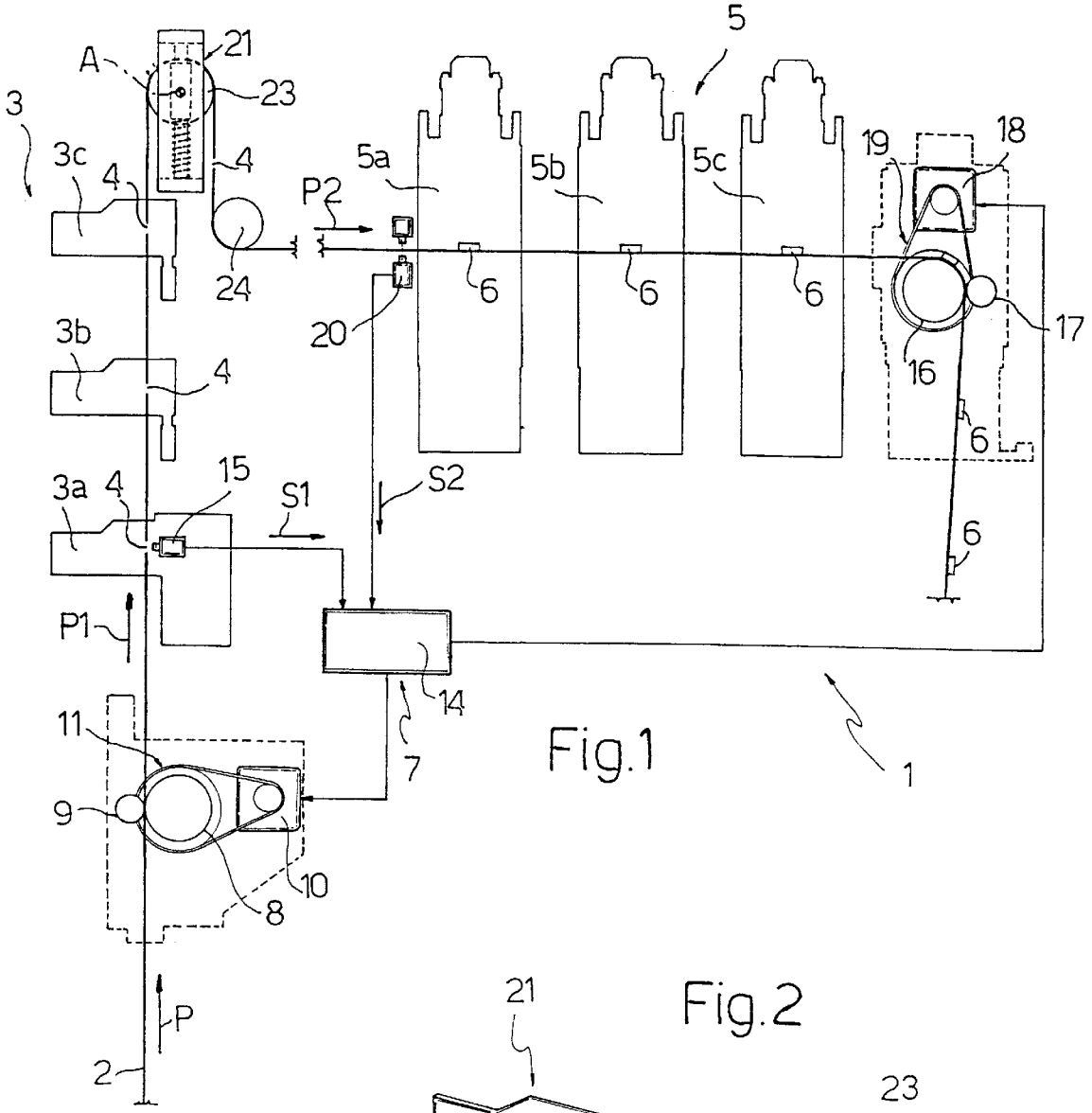
Fig.1
Fig.2
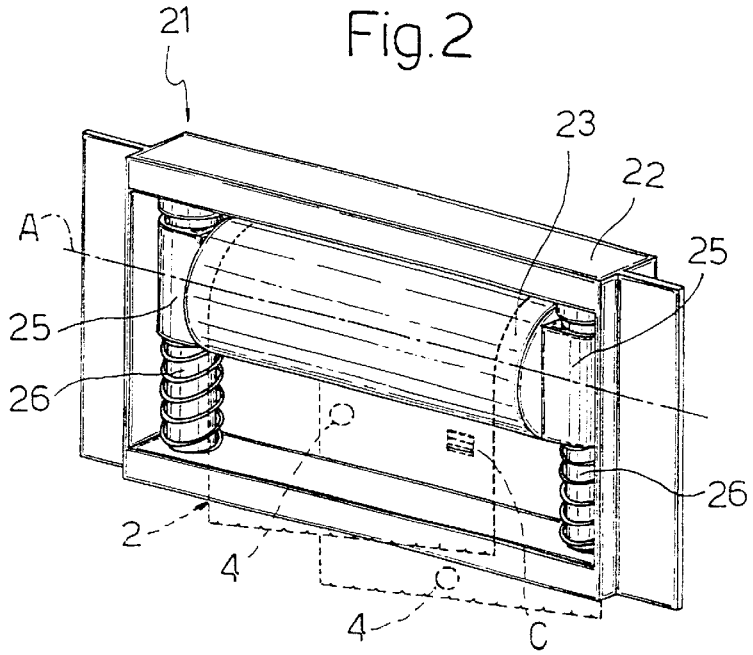

MULTI-STAGE UNIT FOR PROCESSING A WEB PACKAGING MATERIAL IN A FOOD PRODUCT PACKAGING MACHINE

This application claims priority under 35 U.S.C. §§ 119 and/or 365 to Appln. No. 9904728-4 filed in Sweden on Dec. 22, 1999; the entire content of which is hereby incorporated by reference.

FIELD OF THE INVENTION

The present invention relates to a multi-stage unit for processing web packaging material in a food product packaging machine.

BACKGROUND OF THE INVENTION

Many pourable food products, such as fruit juice, pasteurized or UHT (ultra-high-temperature processed) milk, wine, tomato sauce, etc., are sold in packages made of sterilized packaging material.

A typical example of such a package is the parallelepipedal package for liquid or pourable food products known as Tetra Brik Aseptic (registered trademark), which is formed by folding and sealing laminated web packaging material. The laminated packaging material comprises layers of fibrous material, e.g. paper, covered on both sides with thermoplastic material, e.g. polyethylene. In the case of aseptic packages, the side of the packaging material eventually contacting the food product in the package also has a layer of barrier material, such as an aluminium sheet, which in turn is covered with a layer of thermoplastic material.

As is known, such packages are produced on fully automatic packaging machines, in which a continuous tube is formed from the web packaging material.

More particularly, the web of packaging material is sterilized, and then fed to a forming unit where it is longitudinally folded and sealed to form a tube. The tube is then filled with the sterilized or sterile-processed food product, and is sealed by pairs of jaws and then cut at equally spaced transverse bands to form pillow packs, which are subsequently folded mechanically to form the finished, e.g. parallelepipedal, packages.

Upstream from the forming unit, the web material may be fed through a multi-stage processing unit where subsequent auxiliary operations are performed. For example, in case packages are to be made which are provided with opening devices, such as screw caps, hinge caps or pull-tabs, the aforesaid auxiliary operations may include a punching operation for providing holes at selected positions of the web, and the application of the opening devices onto the holes. Opening devices may applied by injection-moulding the opening device directly onto the holes, e.g. as described in WO 98/18609; as an alternative, opening devices may be bonded or thermo-welded to the web packaging material.

In known machines, the web material is step-fed through the multi-stage processing unit by an indexing system including feeding rollers driven by a servomotor which is controlled in response to a position signal generated by an optical sensor detecting a position index on the web, usually a printed pattern such as a bar code repeated along the web at a predetermined pitch.

Particularly in the case of a multi-stage processing unit including a punch station and a moulding station for directly moulding opening devices, extreme position accuracy of the web material in the moulding station is required in order to provide a proper positioning of the web portion surrounding the punched hole inside the moulding cavity for moulding the opening device, and therefore assure correct flow of the injected thermoplastics material into the moulding cavity so as to properly seal the edge of the hole on both sides of the web.

Therefore, a need for further improvement of indexing accuracy exists in the field.

SUMMARY OF THE PRESENT INVENTION

It is an object of the present invention to provide a system for indexing web packaging material in a multistage processing unit of a packaging machine which allows excellent position accuracy in every stage of the unit.

This object is attained by a multi-stage unit for processing a web packaging material in a machine for packaging food products, the unit including at least a first processing station where a first processing operation is performed on the web packaging material, a second processing station where a second processing operation is performed on said web packaging material, and a system for indexing said web packaging material comprising web feeding means for step-feeding said web packaging material through said multi-stage processing unit, sensor means for reading index code means on said web packaging material and a control unit for controlling said web feeding means in response to input signals received from said sensor means, characterised in that said web feeding means includes a first feeding device for step-feeding said web packaging material through said first processing station and a second feeding device for step-feeding said web packaging material through said second processing station, said sensor means including a first sensor detecting a first index code on said web packaging material and generating a first input signal, said first sensor being located in the vicinity of said first processing station, and a second sensor detecting a second index code made on said web packaging material at said first processing station and generating a second input signal, said second sensor being located in the vicinity of said second processing station, said first feeding device and said second feeding device being independently controlled by said control unit in response to said first input signal and second input signal, respectively.

BRIEF DESCRIPTION OF THE DRAWINGS

A preferred embodiment(s) of the invention is/are disclosed in the following description and illustrated in the accompanying drawings, in which:

FIG. 1 is a schematic side elevational view of a multi-stage processing unit provided with an indexing system according to the present invention; and FIG. 2 is a perspective, enlarged-scale view of a detail of FIG. 1.

DETAILED DESCRIPTION OF THE INVENTION

Numeral 1 indicates, as a whole, a multi-stage processing unit forming part of a packaging machine (not shown) in which a continuous tube is formed from a web 2 of packaging material. Web 2 is fed through unit 1 along a path P and is provided with a repeated printed pattern or design conveniently including a bar code C (FIG. 2).

Unit 1 includes a punch station 3 conveniently comprising a plurality of punch tools 3*a*, 3*b*, 3*c* spaced from each other along a first, vertical portion P1 of path P. In punch station 3, the packaging material web 2 is punched so as to produce equally spaced apertures or holes 4 (FIG. 2), e.g. circular in shape, at a pitch corresponding to the length of packaging material which is used to produce a package.

Unit 1 further includes a moulding station 5, including in turn a number of mould tools 5*a*, 5*b*, 5*c* equal to the number of punch tools 3*a*, 3*b*, 3*c*; in moulding station 5, located downstream of punch station 3 along a horizontal section P2 of path P, plastics material opening devices 6 are injection-moulded onto web 2 at holes 4 thereof. A plurality of, e.g. three, injection tools sa, 5*b*, 5*c* are used, "in parallel" with one another, so as to allow web 2 to stop at moulding station 5 for a sufficiently long time to perform injection and obtain solidification of the plastics material, and still attain a high production rate.

Numeral 7 indicates as a whole an indexing system for step-feeding web 2 along unit 1.

The indexing system 7 includes a pair of infeed rollers 8,9 which cooperate with opposite sides of web 2 and are driven by a first servomotor 10. More particularly, servomotor 10 drives roller 8 by means of a first synchronous transmission 11, e.g. a toothed belt transmission; roller 9 is drivingly coupled, e.g. by gears, to roller 8. Infeed rollers 8, 9 are located upstream from punch stations 3 along web path P.

Servomotor 10 is controlled, so as to index web 2, by a control unit 14 which receives a first input signal S1 from an optical reader 15 located in the vicinity of the first punch station 3.

The indexing system 7 also includes a pair of outfeed rollers 16,17 located downstream of stations 3 along web path P. Outfeed rollers 16,17 cooperate with opposite sides of web 2 and are driven by a second servomotor 18; servomotor 18 drives roller 16 by means of a second synchronous transmission 19, e.g. a toothed belt transmission; roller 17 is drivingly coupled, e.g. by gears, to roller 16. Servomotor 18 is controlled by control unit 14 which receives a second input signal S2 from an optical sensor 20 located in the vicinity of moulding station 5, e.g. immediately upstream of the first moulding tool Sa; conveniently, sensor 20 detects the position of holes 4 made by punch stations 31 and servomotor 18 is stopped by control unit 14 according to the reading of sensor 20 so as to precisely locate holes 4 inside respective mould cavities of moulding stations 5.

Therefore, according to the present invention, web 2 is independently indexed both at a first station, such as punch station 3, in response to the position of a is fist indexing code of web, i.e. the pre-printed bar code C, and at a second station such as moulding station 5, in response to the position of a second indexing code, e.g. holes 4, produced on web 2 at the first station.

As a result of independent indexing of web 2 at infeed rollers 8,9 and outfeed rollers 16,17, differences may exist between web infeed and outfeed; such differences are taken up by a tension device 21 interposed between punch station 3 and moulding station 5 along path P and schematically shown in FIG. 2.

Tension device 21 includes a fixed support frame 22 and a tension roller 23 contacted by web 2 with a winding angle of 180°, so as to cause an inversion of the web advance direction towards an idler roller 24 (FIG. 1) from which section P2 of path 2 starts.

Tension roller 22 is rotatable about an axis A perpendicular to sections P1 and P2 of path P and defined by a shaft (not shown) rigidly connected to respective end slides 25 which are slidable along respective lateral guide bars 26 fixed to frame 22. Respective springs 27, coaxial with guide bars 26, push slides 25 in the infeed direction, so as to produce a predetermined, substantially constant tension of web 2.

Differences in web feed at infeed rollers 8, 9 and outfeed rollers 16, 17 due to independent indexing of web 2 are taken up by the "floating" movement of tension roller 23 of tension device 21 along guide bars 26.

The advantages of the present invention are clear from the foregoing description.

In particular, independent indexing at a first and at a second processing station of a multi-stage processing unit, wherein indexing at the second station is performed according to the result of the first processing operation, allows the web position to be controlled very accurately at each station, and the two processing operations to be performed with a high relative position accuracy; this is of particular importance when the processing operation performed in the second station is a direct injection-moulding of opening devices onto web holes, since precise positioning of the web holes in the mould cavities, and therefore optimum sealing and aseptic quality can be obtained.

Clearly, changes may be made to unit 1 as described herein without, however, departing from the scope of the present invention.

In particular, the processing operation performed in each station may be different; in particular, the second processing operation may consist of the application of a pull tab. Furthermore, tension device 21 may be different in structure; e.g., tension roller 23 may be supported by sprung hinged swing arms, as opposed to slides 25.

I claim:

1. A multi-stage unit for processing a web packaging material in a machine for packaging food products, the unit including at least a first processing station where a first processing operation is performed on the web packaging material, a second processing station where a second processing operation is performed on said web packaging material, and a system for indexing said web packaging material comprising web feeding means for step-feeding said web packaging material through said multi-stage processing unit, sensor means for reading index code means on said web packaging material and a control unit for controlling said web feeding means in response to input signals received from said sensor means, said web feeding means includes a first feeding device for step-feeding said web packaging material through said first processing station and a second feeding device for step-feeding said web packaging material through said second processing station, said sensor means including a first sensor detecting a first index code on said web packaging material and generating a first input signal, said first sensor being located in the vicinity of said first processing station, and a second sensor detecting a second index code made on said web packaging material at said first processing station and generating a second input signal, said second sensor being located in the vicinity of said second processing station, said first feeding device and said second feeding device being independently controlled by said control unit in response to said first input signal and second input signal, respectively.

2. A system as claimed in claim 1, further comprising a web tensioning device interposed between said first feeding device and said second feeding device.

3. A system as claimed in claim 2, wherein said web tensioning device includes a tension roller co-operating with said web packaging material and resilient support means for said tension roller balancing the tension of said web packaging material allowing said tension roller to move in response to different feeds of said first feeding device and said second feeding device.

4. A system as claimed in claim 1, wherein said first index code is a preprinted code repeated along said web packaging material.

5. A system as claimed in claim 4, wherein said preprinted code is a bar code.

6. A system as claimed in claim 1, wherein said first processing station is a punch station for making holes on said web packaging material.

7. A system as claimed in claim 6, wherein said second index code is defined by said holes.

8. A system as claimed in claim 6, wherein said second processing station is an injection-molding station for molding opening devices onto said holes.

* * * * *